United States Patent [19]

Massey et al.

[11] 3,957,428

[45] May 18, 1976

[54] TREATMENT OF TEXTILE MATERIALS

[75] Inventors: John Massey; Martin Alan Shepley, both of Runcorn, England; Roger N. Suiter; John M. Murphy, both of Charlotte, N.C.

[73] Assignee: Imperial Chemical Industries Limited, London, England

[22] Filed: Sept. 20, 1972

[21] Appl. No.: 290,738

[30] Foreign Application Priority Data

July 5, 1972 United Kingdom..... 31477/72

[52] U.S. Cl...... 8/111; 8/137; 8/142; 252/95; 252/99; 252/102; 252/186

[51] Int. Cl.$^2$..... D06L 3/02

[58] Field of Search..... 8/11, 137, 142; 252/18, 252/95, 99, 102

[56] References Cited

UNITED STATES PATENTS

| | | | |
|---|---|---|---|
| 3,635,667 | 1/1972 | Keay et al. | 8/111 |
| 3,708,260 | 1/1973 | Marshall et al. | 8/111 |
| 3,762,862 | 10/1973 | Cunningham et al. | 8/111 |

OTHER PUBLICATIONS

Hofstetter, H. H., "Die Anwandung Organischer Loesungsmittel in der Textilveredlung" Melliand Textilgerichte, 3, 1969: pp. 321–334, (English Translation).

White, W. A. S., "Existing and Future Uses of Non–Flammable Solvents in Textile Processing," American Dyestuff Reports July 31, 1967.

*Primary Examiner*—Leland A. Sebastian
*Assistant Examiner*—Irwin Gluck
*Attorney, Agent, or Firm*—Cushman, Darby & Cushman

[57] ABSTRACT

A process for uniformly and thoroughly bleaching textile material having contaminate in the fibers comprising:

1. impregnating the contaminated textile material with a solution of a surface-active agent in a hydrocarbon or halogenated hydrocarbon solvent and steaming the impregnated textile material to remove solvent, whereby substantially all of the contamination in the fibers and the surface-active agent remain in the textile material;
2. impregnating the textile material with the contamination and surface-active agent with an aqueous bleaching solution containing, as a bleaching agent, hydrogen peroxide;
3. steaming the textile material; and
4. washing the textile material with an aqueous medium.

17 Claims, No Drawings

TREATMENT OF TEXTILE MATERIALS

This invention relates to the treatment of textile materials and particularly to a process for the treatment of textile materials to bleach them to substantially full-white shades of high permanency.

We have recently proposed a process for the treatment of textile materials which comprises applying to the textile material a solution or suspension of a treatment agent in a hydrocarbon or a halogenated hydrocarbon solvent, removing the solvent preferably by means of steam, and subsequently washing the textile material in an aqueous medium such as a dilute solution of an alkali or a detergent. Thus in UK Patent Specification No. 1,273,546 we describe and claim such a process wherein there is employed as treatment agent a surface active agent and/or an enzyme desizing agent, and in co-pending UK Patent Application No. 23782/69 and corresponding Belgian Patent Specification No. 750,196, we describe and claim a process wherein the treatment agent is a bleaching agent, e.g. an aqueous solution of hydrogen peroxide. When an enzyme desizing agent or a bleaching agent is employed it will normally be used in conjunction with a surface active agent.

We have found that if the textile material after steaming to remove the solvent but prior to washing in water or an aqueous medium is treated with an aqueous solution of a bleaching agent, for example hydrogen peroxide, and/or a bleaching adjuvant and is again steamed prior to washing, then a high degree of bleaching of the textile fibres results and in the majority of cases a full-white bleach can be achieved.

We have discovered, surprisingly, that the textile material emerging directly from the steam-treatment vessel into the atmosphere after removal of the organic solvent only partially wetted with water (e.g. containing from 10% to 30% by weight of water based on the dry fabric), and containing substantially all the contamination present in the original fibres as well as the treatment agent employed and any products of degradation of size, is very absorbent and can be uniformly and thoroughly impregnated with an aqueous solution of a bleaching agent such as hydrogen peroxide and/or a bleaching adjuvant, so that after re-steaming and washing in water or an aqueous medium the textile material is bleached efficiently to a uniform shade. The process is easy to carry out and provides a uniform prepare of textile materials which are suitable without further treatment for use in subsequent dyeing and other finishing operations. The exceptional absorbency of the treated materials enables extremely good penetration of dyestuffs into the fibres, thereby ensuring dyeing to solid shades which are resistant to shade differences usually noted in abrasion. The time for which the textile material is re-steamed can be as low as 30 seconds so that using the process a loomstate textile fabric can be prepared for dyeing even to light shades in a period of only about two to three minutes.

According to the present invention we provide a process for the treatment of textile materials wherein a textile material has been impregnated with a solution or a suspension of a treatment agent in a hydrocarbon or a halogenated hydrocarbon solvent and then steamed is treated to create thereon an aqueous solution of a bleaching agent and a bleaching adjuvant, the resulting impregnated material is steamed and subsequently the textile material is washed with water or an aqueous medium.

By the term "suspension" as used throughout this specification there is meant a dispersion of a solid in a liquid or an emulsion or one liquid in another liquid.

Usually the aqueous solution of a bleaching agent and a bleaching adjuvant will be created on the textile material by applying thereto both an aqueous solution of the bleaching agent and the bleaching adjuvant but if the textile material after steaming already contains a bleaching agent or a bleaching adjuvant then the said aqueous solution may be created by applying such additional amounts of these as may be required or, if sufficient of one of these is already present, by applying only the bleaching adjuvant or the bleaching agent, as the case may be. In the usual case where both an aqueous solution of the bleaching agent and a bleaching adjuvant are applied, then they may be applied in the form of a single aqueous solution or separately, for example the bleaching adjuvant may be applied prior to or subsequent to the aqueous solution of a bleaching agent.

In one embodiment of the invention, a textile material which has been impregnated with a solution of a surface active agent in a hydrocarbon or a halogenated hydrocarbon solvent and steamed to remove all or substantially all of the organic solvent, is impregnated with an aqueous solution of a bleaching agent and usually also a bleaching adjuvant, the impregnated textile material is again steamed and the material subsequently is washed with water or an aqueous medium.

In a second embodiment of the invention, a textile material which has been impregnated with a suspension of an enzyme desizing agent in a hydrocarbon or halogenated hydrocarbon solvent, preferably containing a surface active agent, and steamed to remove all or substantially all of the solvent, is impregnated with an aqueous solution of a bleaching agent and usually also a bleaching adjuvant, the impregnated textile material is steamed and subsequently is washed with water or an aqueous medium.

In a further embodiment of the invention, a textile material impregnated with a suspension of a bleaching agent in a hydrocarbon or halogenated hydrocarbon solvent, preferably containing a surface active agent, and steamed to remove all or substantially all of the solvent from the resulting textile material, is impregnated with an aqueous solution of a bleaching agent and usually also a bleaching adjuvant, the impregnated textile material is steamed and subsequently is washed with water or an aqueous medium. In a modification of this embodiment the textile material after steaming to remove solvent contains sufficient bleaching agent and is impregnated with an aqueous solution of the bleaching adjuvant only, steamed and subsequently washed.

The bleaching agent may be any such agent known for use in bleaching textiles, for example peroxides, sodium chlorite, sodium hypochlorite and peracetic acid. We prefer to employ hydrogen peroxide. Mixtures of bleaching agents may be used, if desired.

The bleaching adjuvant may be any such agent known in conventional aqueous bleaching processes and usually will be a base. Any base may be used, for example an organic amine, (e.g. triethanolamine), an alkali-metal hydroxide, a metal carbonate or ammonium hydroxide. We prefer to employ an inorganic base, particularly an alkali-metal hydroxide and especially sodium hydroxide. Mixtures of bases may be employed, if desired. Usually the textile material will be impregnated with an aqueous solution containing both the bleaching agent and the base. However, as stated hereinbefore the base may be applied separately and prior to or subsequent to the aqueous solution of the bleaching agent and in this case a suitable technique comprises impregnating the textile material with an aqueous solution of a bleaching agent such as hydrogen peroxide and passing the impregnated material into steam containing ammonia or the vapour of an organic base, for example an organic amine such as an alkylamine, for example diethylamine.

The textile material after steaming to remove all or substantially all of the organic solvent may be impregnated directly with the aqueous solution of the bleaching agent and/or the bleaching adjuvant which may be applied by any convenient method, for example by immersion, padding, licking or spraying. The temperature of the aqueous solution is preferably about or slightly above room temperature since the rate of decomposition of bleaching agents such as hydrogen peroxide rises rapidly as the temperature increases. However, temperatures above room temperature may be used if desired, for example up to 60°C. We prefer to ensure that steam does not pass from the two steam-treatment vessels into contact with the impregnation bath containing the aqueous solution of a bleaching agent although if necessary cooling means may be provided to avoid a rise in temperature of the aqueous solution, especially if impregnation is by immersion. However we have found that there is no real advantage in cooling the textile material, which emerges hot from the steam-treatment vessel, prior to application thereto of the aqueous solution of a bleaching agent. Usually, therefore, the impregnation procedure will comprise withdrawing the textile material from the first (solvent removal) steam-treatment vessel, immediately applying thereto the aqueous solution at a temperature of about room temperature by padding or immersion, and immediately passing the impregnated textile material into the second steam-treatment vessel. It is to be understood, however, that the procedure need not be continuous and that the textile material after solvent removal may be collected for subsequent impregnation and re-steaming which, if desired, may be carried out in a separate apparatus. Also, the final washing in water or an aqueous medium need not immediately follow re-steaming and again it can be effected in a separate apparatus if desired. The full advantage of the present invention, however, is achieved in a continuous process from which the textile material emerges bleached and washed.

The concentration of bleaching agent in the aqueous solution can be the same as is usual in known aqueous bleaching processes. The concentration of 35% hydrogen peroxide in the aqueous solution will usually be from 0.5% to 10% by weight of the solution, normally from 1.5 to 4% by weight. The optimum concentration may depend upon the particular textile material being treated and upon whether the textile material already contains hydrogen peroxide as a result of the previous treatment. We have found that for most practical purposes 35% aqueous hydrogen peroxide in an amount of from 2% to 4% by weight of the solution is sufficient. By way of example a suitable concentration for bleaching of 100% cotton fabrics or polyester/cotton blend fabrics is about 4% by weight of 35% hydrogen peroxide. For any particular fabric the optimum concentration of hydrogen peroxide can be determined by simple experiment.

The aqueous solution of a bleaching agent usually contains in addition the bleaching adjuvant, for example a base such as sodium hydroxide. The amount of base preferably is such that the pH of the aqueous solution created on the textile material is greater than 9.0 and preferably is from 10 to 12.5; for example 5% to 6% by weight of the solution of 50% sodium hydroxide solution. In addition to the base the solution may contain one or more stabilisers for the bleaching agent (themselves bleaching adjuvants) known in the art and, if desired, one or more optical brightening agents. Examples of stabilising agents which may be used to stabilise hydrogen peroxide are sodium silicate, tetrasodium pyrophosphate and ethylene dinitrilo tetracetic acid. Examples of suitable optical brightening agents are caustic stable cellulosic optical brightener Leucophor AC available from Sandoz Chemicals and caustic stable polyester optical brightener Uvitex EBF available from Ciba-Geigy Inc. The amounts of stabilisers and optical brightening agents used may be the same as in conventional bleaching processes.

After the aqueous solution of a bleaching agent and the bleaching adjuvant has been created on the textile material the impregnated material is steamed in any conventional manner. For example the textile material may be passed through the steam treatment continuously in open width or it may be rolled and treated in the form of a roll. The period of steaming will depend upon the temperature and pressure employed and the form, construction and material of which the textile material is made. Typical steaming periods are about 3 minutes for continuous open width treatments and up to 2 hours for batch treatments in which the material is steamed whilst rolled. Steaming may be carried out under normal pressure conditions in which case steam at about 100°C is employed or it may be carried out under superatmospheric pressure in which case steam temperatures up to about 130°C may be achieved. In general the use of superheated steam under pressure reduces the period of steaming, especially when rolls of material are to be treated.

The textile material may be impregnated with the solution of suspension (including emulsion) of the temporary treatment agent in the hydrocarbon or halogenated hydrocarbon solvent by the methods and under the conditions described in detail in the Patent Specification mentioned hereinbefore in which washing techniques and washing conditions also are described. The preferred solvents are trichloroethylene and perchloroethylene. Usually the first wash will be in a dilute solution of an alkali such as sodium carbonate or sodium hydroxide and subsequent washes will be carried out using aqueous solutions of detergents, and finally water. Mixed hot water and cold water washes may be employed if desired and usually the final step will be a rinse in cold water.

A wide range of textiles can be prepared by the process of the invention which is independent of the type of size applied to the textile fibres or the type of fibre (vegetable or man-made) or the heat history of the fibres. The process is especially suited to treatment of fabrics made from cellulosic fibres, notably cotton, or blends of cellulosic fibres and polyester fibres.

The invention is illustrated but in no way limited by the following examples, in which all parts and percentages are by weight unless otherwise stated.

Example 1

Duplicate samples (10g each) of a starch-sized 100% carded cotton fabric, Twill Style 4463, of weight 1.78 square yards per lb were subjected to the following sequence of treatments, in the laboratory:

a. The samples were immersed for 5–10 seconds in a solution (1000 ml) of formulation

| | % |
|---|---|
| trichloroethylene (stabilised grade) | 98.5 |
| enzyme (Nervanase 180) | 0.5 |
| *surface active agent mixture | 1.0 |
| | 100 |

*a 2:1:1 mixture of Lissapol NX, Empilan CDE and Nansa YS94. Lissapol NX is a nonyl phenol/ethylene oxide condensate. Empilan CDE is coconut oil diethanolamide.
Nansa YS94 is isopropylamine dodecyl benzene sulphonate.

b. The samples were expressed to 150% wet pick-up and then suspended in steam at approximately 100°C for 30 seconds to remove the trichloroethylene.

c. The samples were passed from the steamer directly into one of the solutions A and B (1000 ml) of formulation

| | Solution A | Solution B |
|---|---|---|
| 50% aq. hydrogen peroxide | 2.8% | 1.4 to 4.2% |
| tetrasodium pyrophosphate (TSPP) | 10g/l | 10g/l |
| Leucophor AC | 0 or 1g/l | 0 or 1g/l |
| Sodium hydroxide | 30 to 100g/l | 30g/l |
| Water | to 100% | to 100 |

at a temperature of 60°C and immersed therein for 5–10 seconds.

d. The samples were expressed to 100–150% wet pick-up and then suspended in steam at approximately 100°C for 30 seconds.

e. The samples were then washed in hot water until all the surface active agent had been removed.

f. After washing, the samples were dried in a hot air oven at approximately 100°C.

g. The samples were then examined and their Whiteness and Absorbency were determined. For some samples (see Table) % enzyme extractables and % oil, fat and wax contents were also determined, by standard methods:

Whiteness — as blue reflectance using AATCC Method 110–1968 with a Hunter D-40 Reflectometer Absorbency — AATCC Method 79–1968 (not in a conditioning room)

Enzyme extractables — AATCC Method 97–1963

Oil, Fat and Wax content — using 1,1,2-trichloro-1,2,2-trifluoroethane as extraction solvent The results are shown in Table I in which the recorded value is the average of the values determined for the two samples.

COMPARISON

For purposes of comparison, two further samples (10g each) of the fabric were treated by the sequence (a), (b), (e), (f) and (g). The results are also shown in Table I.

CONTROL

In Table I, "Control" represents the untreated fabric.

Table I

| Exp. No. | Solution A (g/l NaOH) | Whiteness (ex Leucophor AC) | Whiteness (+Leucophor AC) | Absorbency Seconds | Enzyme extract % removal | Oil, Fat and Wax % removal |
|---|---|---|---|---|---|---|
| 1 | 30 | 75.6 | 87.5 | 1 | 93 | 67 |
| 2 | 40 | 75.7 | 87.6 | 1 | — | — |
| 3 | 50 | 74.0 | 85.2 | 1 | — | — |
| 4 | 60 | 75.5 | 87.1 | 1 | — | — |
| 5 | 70 | 74.3 | 85.4 | 1 | — | — |
| 6 | 80 | 77.0 | 88.3 | 1 | — | — |
| 7 | 90 | 77.2 | 88.3 | 1 | — | — |
| 8 | 100 | 77.4 | 88.6 | 1 | 91 | 75 |

| Exp. No. | Solution B (% $H_2O_2$) | Whiteness (Leucophor AC) | Whiteness (+Leucophor AC) | Absorbency Seconds | Enzyme extract % removal | Oil, Fat and Wax % removal |
|---|---|---|---|---|---|---|
| 9 | 1.4 | 69.4 | 79.3 | 1 | — | — |
| 10 | 2.1 | 72.6 | 83.0 | 1 | — | — |
| 11 | 2.8 | 73.8 | 85.4 | 1 | 93 | 67 |
| 12 | 3.5 | 74.6 | 86.0 | 1 | — | — |
| 13 | 4.2 | 77.1 | 88.9 | 1 | 65 | 77 |
| 14 | CONTROL | 51.6 | 52.9 | 180+ | — | — |
| 15 | COMPARISON | 50.2 | 51.7 | 1 | 95 | 95 |

EXAMPLE 2

Samples of the cotton fabric described in Example 1 were treated by the procedure, steps (a) to (g) outlined in example, but using the following formulation in step (c):

| | |
|---|---|
| 50% aq. hydrogen peroxide | 2.8% |
| *stabiliser | 10 or 15g/l (see below) |
| Leucophor AC | 0 or 1g/l (see Table II) |
| Sodium hydroxide | 30g/l |
| Water | to 100% |

*The stabilisers were:

| Expt. No. | Stabiliser |
|---|---|
| 1 | borax (10g/l) |
| 2 | EDTA (10g/l) |
| 3 | sodium silicate (10g/l) |
| 4 | EDTA (10g/l) + sodium silicate (5g/l) |
| 5 | borax (5g/l) + TSPP (10g/l) |
| 6 | TSPP (10g/l) |

The results are shown in Table II in which the values for the "Control" and "Comparison" experiments (Example 1) are recorded for convenience.

Table II

| Experiment No. | Whiteness (ex Leucophor AC) | Whiteness (+Leucophor AC) | Absorbency Seconds | Enzyme Extract (% removed) | Oil, Fat and Wax (% removed) |
|---|---|---|---|---|---|
| 1 | 68.7 | 78.2 | 1 | 72 | 61 |
| 2 | 70.6 | 80.5 | 1 | 88 | 60 |
| 3 | 70.2 | 79.7 | 1 | — | — |
| 4 | 69.0 | 78.9 | 1 | 74 | 62 |
| 5 | 73.0 | 83.3 | 1 | — | — |
| 6 | 75.6 | 87.5 | 1 | 93 | 67 |
| CONTROL | 51.6 | 52.9 | 180+ | — | — |
| COMPARISON | 50.2 | 51.7 | 1 | 95 | 95 |

Example 3

Duplicate samples of a starch-sized 50/50 polyester/cotton broadcloth fabric (Style 744) of weight 2.3 square yards per lb were treated by sequence (a) to (g) of Example 1, using in step (c) a formulation

| | |
|---|---|
| 50% aq. hydrogen peroxide | 1.4–2.8% (see Table II) |
| stabiliser (see Table III) | 10 or 15g/l |
| Leucophor AC | 0.5g/l |
| Uvitex EBF | 0.5g/l |
| Sodium hydroxide | 30g/l |
| Water | to 100% |

"Control" and "Comparison" experiments were carried out.

Table III

| Experiment No. | 50% $H_2O_2$ (%) | Stabiliser −(g/l) | Whiteness (ex. o.b.a.) | Whiteness (+ o.b.a.) | Absorbency (seconds) | Enzyme Extract (% removal) | Wax, Oil and Fat (% removal) |
|---|---|---|---|---|---|---|---|
| 1 | 1.4 | TSPP (10) | 71.2 | 80.8 | 1 | 93 | 75 |
| 2 | 2.1 | TSPP (10) | 72.5 | 82.8 | 1 | — | — |
| 3 | 2.8 | TSPP (10) | 73.7 | 84.6 | 1 | 96 | 86 |
| 4 | 2.8 | EDTA (10) | 74.8 | 84.8 | 1 | 99 | 86 |
| 5 | 2.8 | Borax (10) | 74.0 | 84.4 | 1 | — | — |
| 6 | 2.8 | $Na_2SiO_3$(10) | 74.2 | 84.4 | 1 | — | — |
| 7 | 2.8 | EDTA (10)+ $Na_2SiO_3$(5) | 71.7 | 80.5 | 1 | — | — |
| 8 | 2.8 | Borax (5)+ TSPP (10) | 76.5 | 87.0 | 1 | 86 | 64 |
| CONTROL | — | — | 56.2 | 57.8 | 180+ | — | — |
| COMPARISON | — | — | 58.6 | 60.5 | 1 | 90 | 72 |

Example 4

Two samples (10g each) of a polyvinylalcohol-sized 100% carded cotton twill fabric, Style 4494, of weight 1.81 square yards per lb were prepared by the sequence (a) to (g) described in Example 1, but using the following formulation in step (a):

| | % |
|---|---|
| trichloroethylene (stabilised) | 97.0 |
| 35% aq. hydrogen peroxide | 2.0 |
| *surface active agent | 1.0 |
| | 100 |

*as in Example 1 and the following formulation in step (c):

| | |
|---|---|
| 50% aq. hydrogen peroxide | 0–2.5% |
| stabiliser | 0, 5, 10 or 15g/l |
| Leucophor AC | 0 or 1g/l |
| Sodium hydroxide | 10–150g/l |
| Water | to 100% |

A "Control" and a "Comparison" experiment were carried out

| Experiment No. | POST-STEAM BATH (c) 50% $H_2O_2$ (%) | Stabiliser −(g/l) | o.b.a. (g/l) | NaOH (g/l) | Whiteness ex. o.b.a. | Whiteness + o.b.a. | Enzyme Extract (% removed) | Oil, Fat and Wax (% removed) |
|---|---|---|---|---|---|---|---|---|
| 1 | — | — | 1 | 30 | 68.9 | 73.9 | 89 | 73 |
| 2 | — | — | 2.5 | 30 | 69.0 | 74.0 | 89 | 73 |
| 3 | — | — | 5.0 | 30 | 67.2 | 72.3 | 90 | 73 |
| 4 | — | — | 10 | 30 | 68.8 | 78.9 | 91 | 73 |
| 5 | — | — | 5 | 10 | 65.7 | 69.9 | 90 | 67 |
| 6 | — | — | 5 | 20 | 66.8 | 71.5 | 90 | 68 |
| 7 | — | — | 5 | 30 | 67.2 | 72.3 | 90 | 73 |
| 8 | — | — | 5 | 40 | 68.7 | 73.8 | 88 | 78 |
| 9 | — | — | 5 | 50 | 65.8 | 69.8 | 86 | 82 |
| 10 | — | — | 5 | 60 | 67.7 | 72.1 | 85 | 83 |
| 11 | — | — | 5 | 70 | 67.4 | 72.0 | 85 | 84 |
| 12 | — | TSPP(5) | 1 | 30 | 69.6 | 77.7 | 92 | 80 |
| 13 | — | TSPP(10) | 1 | ↑ | 71.7 | 80.1 | 96 | 88 |
| 14 | — | TSPP(15) | 1 | | 68.9 | 76.7 | 96 | 93 |
| 15 | — | $Na_2SiO_3$(5) | 1 | | 65.7 | 72.8 | 94 | 90 |
| 16 | — | $Na_2SiO_3$(10) | 1 | | 65.3 | 71.4 | 93 | 95 |
| 17 | — | $Na_2SiO_3$(15) | 1 | | 69.1 | 76.7 | 88 | 88 |
| 18 | — | EDTA(5) | 1 | | 71.6 | 81.0 | — | — |

-continued

| Experiment No. | POST-STEAM BATH (c) 50% $H_2O_2$ (%) | Stabiliser −(g/l) | o.b.a. (g/l) | NaOH (g/l) | Whiteness ex. o.b.a. | Whiteness + o.b.a. | Enzyme Extract (% removed) | Oil, Fat and Wax (% removed) |
|---|---|---|---|---|---|---|---|---|
| 19 | — | (10) | 1 | ↑ | 72.6 | 82.5 | — | — |
| 20 | — | (15) | 1 | 30 | 73.6 | 82.8 | — | — |
| 21 | — | EDTA(5)+ TSPP(10) | 1 | | 73.6 | 84.0 | 92 | 78 |
| 22 | — | EDTA(10)+ TSPP(5) | 1 | | 72.0 | 81.5 | — | — |
| 23 | — | EDTA(5)+ $Na_2SiO_3$(10) | 1 | | 74.6 | 84.8 | — | — |
| 24 | — | EDTA(10)+ $Na_2SiO_3$(5) | 1 | | 72.6 | 82.1 | — | — |
| 25 | — | Borax(5)+ TSPP(10) | 1 | | 70.0 | 81.4 | — | — |
| 26 | — | Borax(10)+ TSPP(5) | 1 | | 70.6 | 81.6 | — | — |
| 27 | — | Borax (5)+ $Na_2SiO_3$(10) | 1 | | 71.4 | 81.6 | — | — |
| 28 | — | Borax (10)+ $Na_2SiO_3$(5) | 1 | | 71.6 | 81.6 | — | — |
| 29 | — | | | 30 | 69.6 | 77.7 | 96 | 88 |
| 30 | — | | | 40 | 71.3 | 81.8 | 91 | 77 |
| 31 | — | | | 50 | 70.6 | 81.2 | — | — |
| 32 | — | | | 60 | 72.6 | 83.1 | — | — |
| 33 | — | | | 70 | 75.7 | 86.4 | — | — |
| 34 | — | | | 80 | 72.8 | 83.4 | 94 | 75 |
| 35 | — | | Leucophor | 90 | 71.4 | 81.3 | — | — |
| 36 | — | TSPP | AC(1g/l) | 100 | 73.3 | 83.9 | — | — |
| 37 | — | (10g/l) | | 110 | 73.6 | 84.0 | — | — |
| 38 | — | | | 120 | 73.9 | 84.8 | 94 | 92 |
| 39 | — | | | 130 | 75.1 | 86.2 | — | — |
| 40 | — | | | 140 | 74.8 | 86.0 | — | — |
| 41 | — | | | 150 | 76.0 | 87.2 | 87 | 86 |
| 42 | 1.4 | | | | 71.2 | 81.1 | 91 | 72 |
| 43 | 1.5 | | | | 72.8 | 83.5 | — | — |
| 44 | 1.6 | | | | 73.8 | 84.5 | — | — |
| 45 | 1.7 | | | | 73.6 | 84.5 | — | — |
| 46 | 1.8 | | | | 74.0 | 86.2 | — | — |
| 47 | 1.9 | TSPP | Leucophor | 30 | 75.3 | 87.4 | — | — |
| 48 | 2.0 | (10g/l) | AC(1g/l) | | 77.2 | 89.3 | 80 | 67 |
| 49 | 2.1 | | | | 77.1 | 89.6 | — | — |
| 50 | 2.2 | | | | 75.7 | 88.1 | — | — |
| 51 | 2.3 | | | | 75.8 | 88.4 | — | — |
| 52 | 2.4 | | | | 77.4 | 90.0 | 82 | 52 |
| 53 | 2.5 | | | | 76.4 | 88.9 | — | — |
| CONTROL | — | — | — | — | 53.6 | 54.8 | — | — |
| COMPARISON | — | — | — | — | 63.9 | 65.2 | 90 | 40 |

In each of experiments 1 to 53 the treated fabric had an Absorbency of not more than 1 second, whereas the Absorbency of the untreated fabric (Control) was over 180 seconds and the Absorbency of the fabric treated by way of Comparison was 21 seconds.

Example 5

A cotton fabric (Example 4) was treated by the procedure of Example 1 using in step (c) the following formulation, and employing the various steaming times shown in Table V in step (d):

| | |
|---|---|
| 50% aq. hydrogen peroxide | 1.4g/l |
| stabiliser (TSPP) | 10g/l |
| Leucophor AC | 1g/l |

-continued

| | |
|---|---|
| Sodium hydroxide | 30g/l |
| Water | to 100% |

Table V

| Expt. No. | Steaming Time (seconds) | Whiteness (ex. o.b.a.) | Whiteness (+ o.b.a.) | Enzyme Extract (% removed) | Oil, Fat and Wax (% removed) |
|---|---|---|---|---|---|
| 1 | 30 | 72.6 | 83.6 | 88 | 75 |
| 2 | 45 | 72.8 | 83.2 | — | — |
| 3 | 60 | 71.2 | 82.3 | — | — |
| 4 | 90 | 72.2 | 83.6 | — | — |
| 5 | 120 | 73.9 | 85.7 | — | — |
| 6 | 150 | 75.3 | 87.7 | — | — |
| 7 | 180 | 76.2 | 89.3 | 86 | 83 |

Example 6

Duplicate samples of the polyester/cotton fabric (Example 3) were prepared by steps (a) to (g) using in step (c) the formulation:

| | |
|---|---|
| 50% aq. hydrogen peroxide | 0 to 2.8% |
| stabiliser (see Table VI) | 5, 10 or 15g/l |
| Leucophor AC | 0 to 10g/l |
| Uvitex EBF | 0 to 10g/l |
| Sodium hydroxide | 30g/l |

Table VI

| Experiment No. | 50% $H_2O_2$ (%) | Stabiliser(s) (g/l) | o.b.a.(s)* (g/l) | Whiteness (ex o.b.a.) | Whiteness (+ o.b.a) | Enzyme Extract (% removed) | Oil, Fat and Wax (% removed) |
|---|---|---|---|---|---|---|---|
| | | TSPP | EBF | | | | |
| 1 | — | 10 | 1.0 | 73.7 | 80.1 | — | — |
| 2 | — | 10 | 2.5 | 73.5 | 79.7 | — | — |
| 3 | — | 10 | 5.0 | 73.5 | 80.7 | — | — |
| 4 | — | 10 | 10.0 | 73.5 | 80.2 | 84 | 100 |
| 5 | 1.4 | 10 | 1.0 | 73.6 | 80.0 | — | — |
| 6 | 1.4 | 10 | 2.5 | 73.4 | 78.2 | — | — |
| 7 | 1.4 | 10 | 5.0 | 73.5 | 78.2 | — | — |
| 8 | 1.4 | 10 | 10.0 | 73.8 | 59.0 | 90 | 100 |
| | | | AC+EBF | | | | |
| 9 | — | 10 | 0.5+0.5 | 74.9 | 84.5 | — | — |
| 10 | — | 10 | 1+1 | 74.7 | 84.3 | — | — |
| 11 | — | 10 | 2.5+2.5 | 74.5 | 83.9 | — | — |
| 12 | — | 10 | 5+5 | 74.5 | 84.3 | — | — |
| 13 | — | 10 | 10+ 10 | 74.3 | 89.6 | 92 | 100 |
| 14 | 1.4 | 10 | 0.5+0.5 | 75.0 | 85.2 | 98 | 55 |
| 15 | 1.4 | 10 | 1+1 | 74.0 | 82.5 | — | — |
| 16 | 1.4 | 10 | 2.5+2.5 | 73.0 | 81.5 | — | — |
| 17 | 1.4 | 10 | 5+5 | 72.8 | 82.0 | — | — |
| 18 | 1.4 | 10 | 10+10 | 73.1 | 83.2 | — | — |
| 19 | 1.4 | 10 | NONE | 73.5 | — | — | — |
| 20 | 0.7 | 10 | 0.5+0.5 | 74.5 | 84.6 | — | — |
| 21 | 2.8 | 10 | 0.5+0.5 | 75.6 | 86.4 | — | — |
| 22 | — | 5 | 0.5+0.5 | 72.9 | 82.3 | — | — |
| 23 | — | 10 | ↑ | 73.4 | 83.0 | 97 | 58 |
| 24 | — | 15 | | 73.7 | 83.5 | — | — |
| | | EDTA | | | | | |
| 25 | — | 5 | | 68.6 | 78.4 | — | — |
| 26 | — | 10 | | 67.8 | 77.6 | 93 | 33 |
| 27 | — | 15 | | 69.5 | 79.6 | — | — |
| | | EDTA+TSPP | | | | | |
| 28 | — | 5+10 | | 70.0 | 79.6 | — | — |
| | | | 0.5+0.5 | | | | |
| 29 | — | 10+5 | | 68.9 | 78.4 | | — |
| | | EDTA+$Na_2SiO_3$ | | | | | |
| 30 | — | 5+10 | | 68.8 | 77.8 | — | — |
| 31 | — | 10+5 | | 70.8 | 80.5 | 94 | 36 |
| | | Borax+TSPP | | | | | |
| 32 | — | 5+10 | | 72.6 | 82.5 | 92 | 69 |
| 33 | — | 10+5 | | 71.6 | 81.6 | — | — |
| | | Borax+$Na_2SiO_3$ | | | | | |
| 34 | — | 5+10 | ↓ | 72.2 | 82.2 | — | — |
| 35 | — | 10+5 | 0.5+0.5 | 70.8 | 80.6 | 92 | 31 |
| CONTROL | — | — | 0.5+0.5 | 56.2 | 57.8 | — | — |
| COMPARISON | — | — | 0.5+0.5 | 67.4 | 69.6 | 93 | 72 |

*AC = Leucophor AC
EBF = Uvitex EBF

Example 7

A 100% cotton plain-weave fabric of weight 4 oz per square yard was padded at room temperature through a 1% by weight solution of Lissapol NX in trichloroethylene (stabilised grade) and then expressed to 100% wet pick-up. The impregnated fabric was suspended in steam at about 100°C for 30 seconds and then it was padded through a solution of composition

| | % |
|---|---|
| 35% aq. hydrogen peroxide | 4.0 |
| 50% sodium hydroxide | 1.5 |
| Sodium silicate (Q79) | 1.0 |
| Water | 93.5 |
| | 100 |

and expressed to 100% wet pick-up. This impregnated fabric was rolled and the roll was suspended in steam at about 100°C for 1 hour, after which time the fabric was washed in hot water until all the Lissapol NX had been removed, rinsed in cold water and then air-dried.

Results:

| Fabric | Whiteness | Starch Equiv. | Absorbency | Wax Content (%) |
|---|---|---|---|---|
| Untreated | 61.0 | 9.8 | 200+secs. | 0.8 |
| Treated | 78.9 | 0.75 | 1.4 secs. | 0.4 |

*determined using a Zeiss Elrepho Reflectometer

Example 8

A 66:33 polyester:cotton singles 20's rainwear fabric of weight 6 oz per square yard was padded at room temperature through a composition of formulation

| | % |
|---|---|
| trichloroethylene (stabilised) | 98.5 |
| Starch-Enzyme (Solvazyme) | 0.5 |
| Surfactant (Example 1) | 1.0 |
| | 100 |

and expressed to 100% wet pick-up. The impregnated fabric was steamed for 30 seconds at about 100°C and then was padded through the composition

| | % |
|---|---|
| 35% aq. hydrogen peroxide | 4.0 |
| Sodium silicate (Q79) | 1.0 |
| 50% sodium hydroxide | 1.5 |
| Water | 93.5 |

-continued

100 and expressed to 90% wet pick-up

This impregnated fabric was rolled and the roll was steamed at about 130°C for 3 minutes, after which time the fabric was rinsed in water, washed in water until all the surfactant had been removed, and then air-dried.

Results:

| Fabric | *Whiteness | Starch Equiv. | Absorbency | Wax Content (%) |
|---|---|---|---|---|
| Untreated | 70 | 8.6 | 200+secs. | 0.8 |
| Treated | 79 | 1.4 | 1.5 secs. | 0.26 |

*Zeiss Elrepho Reflectometer

Example 9

A 50:50 polyester/"Vincel" (a polynosic viscose rayon available from Courtaulds Ltd.) fabric of weight 5.8 oz per square yard was padded at room temperature through a 1% solution of Lissapol NX in perchloroethylene and expressed to about 100% wet pick-up. The impregnated fabric was steamed at about 100°C for 30 seconds and was then padded through an aqueous solution of hydrogen peroxide (4% of 35% $H_2O_2$), sodium hydroxide (1.5% of 50% NaOH) and sodium silicate, (Q79 — 1%) and expressed to about 100% wet pick-up.

The impregnated fabric was steamed in open width at 100°C for 2 minutes after which it was rinsed in hot water, washed in hot water until all the surfactant had been removed and then air-dried Results:

| Fabric | *Whiteness | Starch Equiv. | Absorbency | Wax Content (%) |
|---|---|---|---|---|
| Untreated | 72.7 | 0.73 | 2 secs. | 3.17 |
| Treated | 78.4 | 0.28 | 1 sec. | 0.17 |

*Zeiss Elrepho Reflectometer

Example 10

Strips of width 6 inches of cotton shirting fabric (4 oz per square yard) and 60:30 polyester:cotton singles 20's rainwear (6 oz per square yard) were passed continuously in open width through a pilot plant in which they were subjected to:

a. the strips were padded at room temperature through Solution A or Emulsion B and expressed to 120% pick-up.

| Solution A | Parts | Emulsion B | Parts |
|---|---|---|---|
| trichloroethylene | 99 | trichloroethylene | 98.5 |
| *surface active | 1 | *surface active agent | 1 |
| agent | 100 | enzyme (Nervanase 180) | 0.5 |
| | | | 100.0 |

*a 2:1:1 mixture of Lissapol NX, Empilan CDE and Nansa YS94.

b. the impregnated strips were suspended in steam at approximately 100°C for 30 seconds to remove substantially all of the trichloroethylene.

c. the strips were padded at room temperature through an aqueous solution of hydrogen peroxide and sodium hydroxide and expressed to 100% pick-up.

| Aqueous Bleach Solution | Percentage |
|---|---|
| hydrogen peroxide (35%) | 4 |
| sodium silicate (Q.79) | 10 |
| sodium hydroxide (100° Twaddle) | 5 |
| magnesium sulphate | 0.02 |

d. the impregnated strips were suspended in steam at approximately 100°C for the period of time shown in Table VII below, and e. the strips were washed for 5 minutes in water at 98°C and then were ironed dry.

f. Prior to testing the strips were conditioned for over two hours at 20°C ± 2°C and 65% RH ± 4%.

Table VII

| Fabric | Step A | *Blue Reflectance (%) | | | | |
|---|---|---|---|---|---|---|
| Cotton | UN-TREATED | 55.8 | | | | |
| Cotton | Solution A | 72 | 74 | 80.5 | 80 | 77 |
| Cotton | Emulsion B | 69 | 76 | 76 | 77 | 79 |
| Polyester/cotton | UN-TREATED | 70.0 | | | | |
| Polyester/cotton | Solution A | 78 | 78.5 | 80 | 81 | 81 |
| Polyester/cotton | Emulsion B | 78 | 79 | 79.5 | 80 | 80 |

*after steaming times of 0.5, 1, 2, 5 and 10 minutes. Blue Reflectance is determined using a Zeiss Elrepho Reflectometer and recording four readings of which two are recorded to each side of the fabric, one along the warp and the other along the weft. The recorded figure is the mean value of the four readings.

Example 11

Strips of cotton and polyester/cotton fabrics as in Example 10 were treated by the following sequence:

a. the strips were padded at room temperature through Solution A or Emulsion B (Example 10) and expressed to 120% pick-up.

b. the impregnated strips were suspended in steam at approximately 100°C for 30 seconds.

c. the strips were padded at ambient temperature through an aqueous bleach solution as in Example 10 but containing varying amounts of hydrogen peroxide as shown in Table VIII.

d. the impregnated strips were rolled on a glass rod and covered with polyethylene film.

e. the rolls were suspended in steam at approximately 100°C for the desired period of time, and f. the strips were washed with water at 98°C for 5 minutes and then ironed dry.

g. The strips were conditioned for over 2 hours at 20°C ± 2°C and 65% RH ± 4%.

The Blue Reflectance of the treated fabrics was determined and the results are shown in Table VIII.

In addition the starch equivalent and wax content of some of the treated fabrics was determined and the results are shown in Table VIIIA.

Table VII

| Fabric | Step (a) | 35% $H_2O_2$ concn. (%) | *Blue Reflectance (%) | | | | | |
|---|---|---|---|---|---|---|---|---|
| Cotton | UNTREATED | | 55.8 | | | | | |
| Cotton | Solution A | 4 | 73.3 | 74.2 | 80.4 | 82.2 | 79.3 | 78.4 |
| | | 6 | — | 77.3 | 87.0 | 86.5 | — | 83.2 |

Table VII-continued

| Fabric | Step (a) | 35% $H_2O_2$ concn. (%) | *Blue Reflectance (%) | | | | | |
|---|---|---|---|---|---|---|---|---|
| | | 8 | — | — | — | 87.4 | — | — |
| Cotton | Emulsion B | 4 | 68.6 | 76.6 | 82.3 | 82.6 | 83.6 | 78.3 |
| | | 6 | — | 76.5 | 84.7 | 86.1 | — | 86.5 |
| | | 8 | — | — | — | 88.5 | — | — |
| Polyester/ Cotton | UNTREATED | | 70.0 | | | | | |
| Polyester/ Cotton | Solution A | 4 | 76.3 | 79.3 | 79.8 | 79.0 | 78.1 | 78.5 |
| | | 6 | — | 79.7 | 79.5 | 79.6 | — | 79.4 |
| | | 8 | — | — | — | 79.9 | — | — |
| Polyester/ Cotton | Emulsion B | 4 | 78.5 | 78.2 | 79.7 | 79.9 | 79.2 | 79.0 |
| | | 6 | — | 79.5 | 78.8 | 79.8 | — | 78.7 |
| | | 8 | | | | | | |

*after steaming times of 2, 5, 10, 15, 20 and 30 minutes.

Table VIIIA

| Fabric | Step (a) | 35% $H_2O_2$ concn. (%) | Time in Steam (mins) | Starch Equiv. | Wax (%) |
|---|---|---|---|---|---|
| Cotton | UNTREATED | | | 9.99 | 1.4 |
| Cotton | Solution A | 4 | 10 | 0.8 | 0.33 |
| | | 6 | 10 | 0.9 | 0.40 |
| | | 6 | 15 | 0.9 | 0.44 |
| | | 6 | 30 | 0.6 | 0.45 |
| | | 8 | 15 | 0.8 | 0.33 |
| Cotton | Emulsion B | 4 | 10 | 0.8 | 0.33 |
| | | 6 | 10 | 1.2 | 0.45 |
| | | 6 | 15 | 1.7 | 0.40 |
| | | 6 | 30 | 0.86 | 0.32 |
| | | 8 | 15 | 0.9 | 0.33 |

Example 12

Strips of cotton and polyester/cotton fabric (Example 1) were treated by the following sequence:

a. the strips were impregnated at room temperature with Solution A or Emulsion B (Example 10) and expressed to 120% pick-up.
b. the impregnated strips were suspended in steam at approximately 100°C for 15 seconds or 30 seconds (see Table IX).
c. the strips were impregnated at ambient temperature with a bleach solution at 60% pick-up containing various amounts of hydrogen peroxide as shown in Table IX.
d. the impregnated strips were suspended in steam at approximately 130°C under superatmospheric pressure for 2 or 3 minutes (see Table IX) in a laboratory-scale pressure bleaching unit.
e. the strips were washed with water at 98°C for 5 minutes and then ironed dry.
f. The strips were conditioned for over 2 hours at 20°C ± 2°C and 65% RH ± 4% prior to testing.

The Blue Reflectance of the treated fabrics was determined and is shown in Table IX.

In addition, the absorbency, starch equivalent and % wax content of some of the treated fabrics were determined and are shown in Table IXA.

Table IX

| Fabric | Step (a) | Time in Steam at 100°C (secs) | 35% $H_2O_2$ concn. (%) | Blue Reflectance (%) | |
|---|---|---|---|---|---|
| Cotton | UNTREATED | | | 55.8 | |
| Cotton | Solution A | 15 | 2 | 78 | 82 |
| | | | 3 | 83 | 79 |
| | | | 4 | 84 | 81 |
| | | 30 | 2 | 80 | 83 |
| | | | 3 | 83 | 83 |
| | | | 4 | 84 | 84 |
| Cotton | Emulsion B | 15 | 2 | 74 | 81 |
| | | | 3 | 82 | 83 |
| | | | 4 | 83.5 | 84 |
| | | 30 | 2 | 78 | 81.5 |
| | | | 3 | 82 | 82 |
| | | | 4 | 84 | 84 |
| Polyester/ Cotton | UNTREATED | | | 70.0 | |
| Polyester/ Cotton | Solution A | 15 | 2 | 78 | 79 |
| | | | 3 | 79 | 80 |
| | | | 4 | 80 | 80 |
| | | 30 | 2 | 79 | 80 |
| | | | 3 | 80 | 81 |
| | | | 4 | 80 | 80 |
| Polyester/ Cotton | Emulsion B | 15 | 2 | 78.5 | 80 |
| | | | 3 | 80 | 80.5 |
| | | | 4 | 80 | 80 |
| | | 30 | 2 | 79 | 80 |
| | | | 3 | 79.5 | 80 |
| | | | 4 | 80 | 80.5 |

*after steaming times at 130°C for 2 mins and 3 mins

Table IXA

| Fabric | Step (a) | Time in Steam at 100°C (secs) | 35% $H_2O_2$ concn. (%) | Absorbency (secs) ** | | Starch Equiv. * | Wax (%) * |
|---|---|---|---|---|---|---|---|
| Cotton | UNTREATED | | | >200 | | 9.99 | 1.4 |
| Cotton | Solution A | 15 | 2 | 1.5 | 2.0 | 0.698 | 0.827 |
| | | | 3 | 1.5 | 2.0 | | |
| | | | 4 | 1.0 | 1.5 | | |
| | | 30 | 2 | 1.5 | 2.0 | 0.72 | 0.84 |
| | | | 3 | 1.5 | 2.5 | | |
| | | | 4 | 1.5 | 1.5 | | |
| Cotton | Emulsion B | 15 | 2 | 2.0 | 2.0 | 1.426 | 0.833 |
| | | | 3 | 1.5 | 2.5 | | |
| | | | 4 | 1.5 | 2.0 | | |
| | | 30 | 2 | 2.0 | 2.0 | 2.24 | 0.691 |
| | | | 3 | 1.5 | 1.5 | | |
| | | | 4 | 1.5 | 1.5 | | |
| Polyester/ Cotton | UNTREATED | | | >200 | | 8.5 | 1.1 |
| Polyester/ Cotton | Solution A | 15 | 2 | 1.5 | 1.5 | 1.33 | 0.254 |
| | | | 3 | 1.5 | 1.5 | | |
| | | | 4 | 1.0 | 2.0 | | |

Table IXA-continued

| Fabric | Step (a) | Time in Steam at 100°C (secs) | 35% $H_2O_2$ concn. (%) | Absorbency (secs) ** | | Starch Equiv. * | Wax (%) * |
|---|---|---|---|---|---|---|---|
| Cotton | UNTREATED | | | >200 | | 9.99 | 1.4 |
| | | 30 | 2 | 1.5 | 1.0 | 1.13 | 0.394 |
| | | | 3 | 1.0 | 1.5 | | |
| | | | 4 | 1.5 | 2.0 | | |
| Polyester/ Cotton | Emulsion B | 15 | 2 | 2.0 | 1.2 | 0.390 | 0.059 |
| | | | 3 | 1.0 | 2.0 | | |
| | | | 4 | 1.5 | 2.0 | | |
| | | 30 | 2 | 1.5 | 2.0 | 1.15 | 0.411 |
| | | | 3 | 1.5 | 1.5 | | |
| | | | 4 | 1.5 | 1.5 | | |

* after steaming at 130°C for 3 minutes.
** after steaming at 130°C for 2 minutes and 3 minutes.

Example 13

A small sample of a polyester/cotton (60:30) fabric of weight 5.74 oz per sq yd were immersed at room temperature in an emulsion and expressed to 130% pick-up.

| Emulsion | Temperature |
|---|---|
| trichloroethylene | 97 |
| aqueous hydrogen peroxide (35%) | 2 |
| * surface active agent | 1 |
| | 100 |

* as in Example 10.

The impregnated fabric was suspended in steam at about 100°C for 30 seconds after which it was immersed at room temperature in 5% w/w aqueous sodium hydroxide solution and expressed to 130% pick-up. The resulting impregnated fabric was suspended in steam at about 100°C for 2 minutes after which it was washed for 1 minute with dilute (5 g/l) sodium hydroxide solution at 98°C, for 60 seconds with water at 98°C and finally for 15 minutes with water at room temperature. The resulting fabric was ironed dry.

The fabrics were conditioned and their Blue Reflectance, Absorbency, Starch Equivalent and Wax Contents were determined. The results are shown in Table X.

For purposes of comparison the procedure was repeated except that the impregnation with sodium hydroxide and re-steaming were omitted. The results also are shown in Table X Table X

| Fabric | Steaming Time (mins) | Blue Reflectancy (%) | Absorbency (secs) | Starch Eq. | Wax (%) |
|---|---|---|---|---|---|
| Polyester/ Cotton | UN-TREATED | 68.8 | 7200 | 3.41 | 0.923 |
| | 2 | 79.8 | instant | 0.271 | 0.467 |
| | comparison | 77.2 | instant | 0.159 | 0.386 |

Example 14

The procedure described in Example 13 was employed to treat a cotton fabric of weight 4.82 oz per sq yd; the only difference being that after impregnation the fabric was expressed to 125% pick-up instead of 130% pick-up.

The experiment was repeated twice but using steaming times of 10 minutes and 30 minutes respectively instead of 2 minutes.

Table XI

| Fabric | Steaming Time (mins) | Blue Reflectancy (%) | Absorbency (secs) | Starch Eq. | Wax (%) | Fluidity |
|---|---|---|---|---|---|---|
| Cotton | UN-TREATED | 61.9 | 7200 | 1.36 | 0.85 | 2.1 |
| | 2 | 75.8 | instant | 0.64 | 0.29 | 4.3 |
| | 10 | 75.9 | instant | 0.41 | 0.35 | 4.2 |
| | 30 | 71.6 | instant | 0.24 | 0.30 | 3.8 |
| | Comparison | 72.8 | instant | 0.82 | 0.47 | 3.0 |

Cotton seeds in the fabric were virtually unaffected by the comparison experiment and the procedure involving steaming for 2 minutes only. When the steaming time was increased to 10 minutes approximately half of the seeds were fully bleached and steaming for 30 minutes resulted in bleaching of almost all seeds.

Example 15

10 g sample swatches of a heavy, 100% cotton corded twill fabric (wax content 0.60) sized with polyvinyl alcohol (Starch Equivalent 7.77) (1.81 sq yd per lb) were immersed for 15 seconds in an emulsion such as is described in Example 13 in a beaker and expressed to 200% pick-up.

The impregnated swatches were suspended in steam for 30 seconds and then were padded through an aqueous solution containing 2% of 35% aqueous hydrogen peroxide, 5 g/l of an optical brightening agent (Leucophor AC) and 10 g/l sodium hydroxide and maintained at 60°C. In six further experiments the sodium hydroxide content of the solution was increased to 20, 30, 40, 50, 60 and 70 g/l respectively. The swatches were expressed to 160% pick-up and then were suspended in steam at about 100°C for 30 seconds. The fabrics were then washed as described in Example 13.

In each experiment the Blue Reflectance, Absorbency, percentage size removal and percentage wax removal was determined and the results are shown in Table XII.

Table XII

| Concn.NaOH g/l | Blue Reflectance (%)* I | II | Absorbency (secs) | % size removed | % oil/wax removed |
|---|---|---|---|---|---|
| UN-TREATED | 53.6 | — | 3 mins | — | — |
| 10 | 65.7 | 69.9 | instant | 90 | 67 |
| 20 | 66.8 | 71.5 | instant | 90 | 68 |
| 30 | 67.2 | 72.3 | instant | 90 | 73 |
| 40 | 68.7 | 73.8 | instant | 88.5 | 78 |
| 50 | 65.8 | 69.8 | instant | 85.5 | 82 |
| 60 | 67.7 | 72.1 | instant | 85 | 83 |
| 70 | 67.4 | 72.0 | instant | 85 | 85 |

*I excludes effect of optical brightener
II includes this effect.

For purposes of comparison, a further swatch was treated as described above but the second impregnation and second steaming steps were omitted. The Blue Reflectance was 63.9% Absorbency was instantaneous, percentage size removed was 90% and percentage oil/-wax removed was 40%.

Example 16

The procedure of Example 15 was repeated but in this case the concentration of sodium hydroxide was maintained at 30 g/l and the concentration of the optical brightening agent (Leucophor AC) was varied.

Table XIII

| Concn. o.b.a. (g/l) | Blue Reflectance (%) I | II | Absorbency (secs) | % size removed | % oil/wax removed |
|---|---|---|---|---|---|
| UNTREATED | 53.6 | — | 3 mins | — | — |
| 2.5 | 69.0 | 74.0 | instant | 89 | 73 |
| 5.0 | 67.2 | 72.3 | instant | 90 | 73 |
| 10.0 | 68.8 | 78.0 | instant | 91 | 73 |

Example 17

The procedure of Example 15 was repeated but in this case the concentrations of sodium hydroxide and the optical brightening agent in the bleaching liquor were maintained at 30 g/l and 10 g/l respectively and a peroxide-stabilising agent was incorporated in an amount of 5, 10 or 15 g/l.

In a further series of experiments the above procedure was followed but the concentration of sodium hydroxide was increased to 40 g/l.

Table XIV

| Concn. NaOH (g/l) | Stabiliser* (g/l) | Blue Reflectance (%) I | II | % size removed | % oil/wax removed |
|---|---|---|---|---|---|
| UNTREATED | — | 53.6 | — | — | — |
| 30 | A - 5 | 71.7 | 80.1 | 92 | 80 |
| 30 | 10 | 69.6 | 77.7 | 96 | 88 |
| 30 | 15 | 68.9 | 76.7 | 96 | 93 |
| 30 | B - 5 | 65.7 | 72.8 | 94 | 90 |
| 30 | 10 | 65.3 | 71.4 | 93 | 95 |
| 30 | 15 | 69.1 | 76.7 | 88 | 88 |
| 40 | A - 5 | 70.5 | 78.4 | 90 | 70 |
| 40 | 10 | 70.3 | 78.8 | 90 | 68 |
| 40 | 15 | 70.6 | 79.2 | 86 | 60 |

* A = TSPP (tetrasodium pyrophosphate)
B = sodium silicate

In each experiment the treated swatch absorbed water instantaneously.

What we claim is:

1. A process for uniformly and thoroughly bleaching textile material having contaminate in the fibers comprising:

1. impregnating the contaminated textile material with a solution of a surface-active agent in a hydrocarbon or halogenated hydrocarbon solvent and steaming the impregnated textile material to remove solvent, whereby substantially all of the contamination in the fibers and the surface-active agent remain in the textile material;

2. impregnating the textile material with the contamination and surface-active agent with an aqueous bleaching solution containing, as a bleaching agent, hydrogen peroxide;
3. steaming the textile material; and
4. washing the textile material with an aqueous medium.

2. The process of claim 1 wherein a bleaching adjuvant is applied to the textile material prior to or with or subsequent to the impregnation with the bleaching agent.

3. A process as claimed in claim 1 in which an aqueous solution of the bleaching agent and an aqueous solution of bleaching adjuvant is applied to the textile material.

4. A process as claimed in claim 3 in which an aqueous solution of the bleaching agent and the bleaching adjuvant are applied separately to the textile material.

5. A process as claimed in claim 4 wherein an aqueous solution of the bleaching agent is applied to the textile material and the textile material is then passed into an atmosphere of steam and the vapour of a base to create thereon the aqueous solution of the bleaching agent and a bleaching adjuvant and to steam the textile material.

6. A process as claimed in claim 5 wherein the said vapour of a base comprises ammonia.

7. A process as claimed in claim 1 wherein the amount of hydrogen peroxide in the aqueous solution of the bleaching agent and the bleaching adjuvant is from 0.5 to 10% by weight of the solution calculated as 35% hydrogen peroxide.

8. A process as claimed in claim 7 wherein the amount is approximately 4% by weight.

9. A process as claimed in claim 1 wherein the bleaching adjuvant is a water-soluble base.

10. A process as claimed in claim 9 wherein the base is sodium hydroxide.

11. A process as claimed in claim 1 wherein the bleaching adjuvant contains a stabiliser for hydrogen peroxide.

12. A process as claimed in claim 9 wherein the pH of the aqueous solution of the bleaching agent and the bleaching adjuvant is greater than 9.

13. A process as claimed in claim 12 wherein the pH is from 10 to 12.

14. A process as claimed in claim 10 wherein the amount of the sodium hydroxide is from 5 to 6% by weight calculated as 50% sodium hydroxide, based on the aqueous solution of the bleaching agent and the bleaching adjuvant.

15. A process as claimed in claim 1 wherein the aqueous solution of a bleaching agent and a bleaching adjuvant includes an optical brightening agent.

16. A process as claimed in claim 1 wherein the textile material after creation thereon of said aqueous solution is subjected to steam at about 100°C.

17. A process as claimed in claim 1 wherein the textile material after creation thereon of said aqueous solution is subjected to superheated steam.

* * * * *